US007077210B2

(12) United States Patent
MacKay et al.

(10) Patent No.: US 7,077,210 B2
(45) Date of Patent: Jul. 18, 2006

(54) EXPANSION METHOD

(75) Inventors: Alexander Craig MacKay, Banchory (GB); Neil Andrew Abercrombie Simpson, Portlethen (GB)

(73) Assignee: Weatherford/Lamb, Inc., Houston, TX (US)

( * ) Notice: Subject to any disclaimer, the term of this patent is extended or adjusted under 35 U.S.C. 154(b) by 238 days.

(21) Appl. No.: 10/616,061

(22) Filed: Jul. 9, 2003

(65) Prior Publication Data

US 2004/0055754 A1 Mar. 25, 2004

(30) Foreign Application Priority Data

Jul. 10, 2002 (GB) ..... 0215918.4

(51) Int. Cl.
*E21B 23/00* (2006.01)
*E21B 17/02* (2006.01)

(52) U.S. Cl. ..... 166/380; 166/207; 166/242.1; 166/242.6

(58) Field of Classification Search ..... 166/380, 166/242.1, 206, 207, 242.6
See application file for complete search history.

(56) References Cited

U.S. PATENT DOCUMENTS

| | | | | |
|---|---|---|---|---|
| 6,425,444 | B1 | 7/2002 | Metcalfe et al. | 166/387 |
| 6,457,532 | B1 | 10/2002 | Simpson | 166/380 |
| 6,561,227 | B1 | 5/2003 | Cook et al. | |
| 6,598,677 | B1 * | 7/2003 | Baugh et al. | 166/285 |
| 6,725,918 | B1 | 4/2004 | Gano | |
| 6,749,026 | B1 * | 6/2004 | Smith et al. | 166/313 |
| 6,808,022 | B1 * | 10/2004 | Smith | 166/382 |
| 6,942,029 | B1 * | 9/2005 | Simpson | 166/207 |
| 2002/0108756 | A1 | 8/2002 | Harrall et al. | 166/382 |
| 2004/0149431 | A1 * | 8/2004 | Wylie et al. | 166/242.1 |
| 2004/0168808 | A1 * | 9/2004 | Smith | 166/313 |
| 2004/0221996 | A1 * | 11/2004 | Burge | 166/380 |
| 2005/0039910 | A1 * | 2/2005 | Lohbeck | 166/242.1 |

FOREIGN PATENT DOCUMENTS

| | | | |
|---|---|---|---|
| FR | 2 741 907 | | 6/1997 |
| GB | 2345308 | | 5/2000 |
| RU | 2064357 | * | 7/1996 |
| RU | 2079633 | * | 5/1997 |
| WO | WO 99/35368 | | 7/1999 |
| WO | WO 02/29199 | | 4/2002 |
| WO | WO 02/35058 | | 5/2002 |
| WO | WO 02/086286 | | 10/2002 |
| WO | WO 03/048521 | | 6/2003 |

OTHER PUBLICATIONS

Int'l Search Report, GB 0215918.4, Oct. 16, 2002.
International Search Report for International Application No. PCT/GB03/02930 dated Feb. 23, 2003.

* cited by examiner

*Primary Examiner*—Hoang Dang
(74) *Attorney, Agent, or Firm*—Patterson & Sheridan, L.L.P.

(57) ABSTRACT

A method of expanding tubing downhole comprises the steps of: providing tubing (14;44) of a first diameter; running the tubing into a bore (10;40); expanding a first section of the tubing to a second diameter, and expanding a second section of the tubing to a third diameter.

41 Claims, 5 Drawing Sheets

EXPANSION METHOD

FIELD OF THE INVENTION

This invention relates to an expansion method, and in particular to a method of expanding tubing downhole.

BACKGROUND OF THE INVENTION

The oil and gas exploration and production industry is making increasing use of expandable tubing in a wide variety of applications, including use as casing and liner, in straddles, and as a support for expandable sand screens. Initially, expandable tubing was proposed for use primarily in combination with traditional fixed diameter casing and liner. However, more recently, various proposals have been put forward to utilise expandable tubing to create wells of substantially constant diameter ("monobore" wells), where all or at least a significant proportion of the well is lined with expanded tubing.

Various forms of expansion tools have been utilised to expand tubing downhole, including expansion cones and mandrels which are pushed or pulled through tubing by mechanical or hydraulic forces. Rotary expansion tools have also been used, and these typically feature rollers which are urged outwardly, or which define a fixed diameter, for rolling contact with the tubing to be expanded; the tool is rotated and advanced through the tubing.

It is among the objectives of embodiments of the present invention to provide sections of bore lined with expanded bore-lining tubing of a variety of diameters.

SUMMARY OF THE INVENTION

According to the present invention there is provided a method of expanding tubing downhole, the method comprising the steps of:

providing tubing of a first diameter;

running the tubing into a bore;

expanding a first section of the tubing to a second diameter; and expanding a second section of the tubing to a third diameter.

The entire length of the tubing may be expanded, or a portion of the tubing may remain unexpanded, at said first diameter.

This aspect of the invention permits provision of expanded downhole tubing having sections of different diameters, to suit the individual requirements of respective sections of the bore. For example, a section of bore may have been underreamed, and it may be desired to line the bore with tubing which, when expanded, will define a larger diameter bore within the underreamed section and a smaller diameter bore beyond the ends of the reamed section. In other applications, it may be convenient to have a section of lined bore defining a larger diameter to provide an annulus around, or otherwise accommodate, a relatively large diameter device or tool, such as a downhole pump. Thus it may then not be necessary to drill an extended section of bore of a large diameter where only a short section of a larger diameter is required and may be achieved by selective underreaming, provided of course that the large diameter tool or device may be run in through the smaller diameter bore section. In another application, it may be desired to expand a first section of tubing to a larger second diameter and into sealing contact with the surrounding bore wall, while it is desired to expand a second section of the tubing to a smaller third diameter to provide an annulus between the expanded tubing and the bore wall to accommodate a cement seal. The expansion of the first section in this method would preferably involve use of a compliant expander, that is an expander that has the ability to expand tubing to a non-uniform or non-circular form, and thus accommodate, for example, variations in the bore wall diameter.

The first and second expansion steps may take place simultaneously, and this may be achieved by providing first and second expansion tools on a common support, and operating the expansion tools simultaneously on different sections of the tubing. In this situation, the expansion tools may take any appropriate form, including fixed diameter expansion cones. Of course, if an expansion cone is required to pass through a tubing section of smaller diameter than the expansion cone without expanding the section, the cone must be retractable or otherwise configurable to assume a smaller diameter, as described for example in applicant's U.S. Pat. No. 6,012,523, the disclosure of which is incorporated herein by reference.

In other embodiments, the second expansion step may follow the first expansion step. In this situation, a common expansion tool may be utilised, such as a rolling expansion tool provided with radially extendable expanding members which may assume two or more diameters, the rolling members being arranged in a first configuration for the first expansion step and a second configuration for the second expansion step. Alternatively, different expansion tools may be utilised for the first and second expansion steps and may be mounted on different support members.

Where the third diameter is larger than the second diameter, the second section of tubing may be expanded to the second diameter before being expanded to the third diameter.

The tubing may be formed of a single tubing length, or may be formed of a plurality of tubing lengths which are joined end-to-end. The configuration of the tubing may be substantially constant, for example the tubing may consist solely of solid walled tubing, or the configuration of the tubing may vary along its length, for example including solid walled sections, slotted or otherwise perforated wall sections, and sections formed of expandable sand screen.

Where the tubing comprises a plurality of tubing lengths, these may be run into the bore and expanded separately. In one embodiment, the ends of adjacent tubing lengths may overlap. A first tubing length may be run into the bore and expanded to said second diameter, or indeed may already be of said second diameter. A second tubing length may then be run into the bore, beyond the first tubing length, but with the upper end of the second tubing overlapping the lower end of the first tubing. The upper end of the second tubing then be expanded to said third diameter, preferably such that the overlapping ends of the tubing are in sealing contact. The remainder of the second tubing may then be expanded to said second diameter. This process may be repeated for subsequent tubing lengths, to create a lined bore of substantially constant diameter, corresponding to the second diameter, but having relatively short sections of tubing where the diameter corresponds to said lesser third diameter. Typically, the difference between the second and third diameters will correspond to the wall thickness of the tubing and thus will be small, relative to the bore diameter. Nevertheless, the resulting profiles may be useful for locating tools and devices in the bore. The upper ends of the tubing sections may be chamfered or otherwise profiled, to provide a smooth transition between the different diameter sections, or may provide a ledge or otherwise abrupt transition, to assist in locating tools or devices in the bores.

In other embodiments, the upper end of the second tubing may be expanded to a smaller diameter, such that the overlapping ends of the tubing are spaced apart or otherwise define a fluid passage therebetween, to facilitate flow of fluid between the overlapping ends. This may be useful in cementing operations, where fluid is displaced from the annulus between the second tubing and the surrounding bore wall.

The invention also relates to bores lined in this manner.

In other aspects of the invention, tubing of a first diameter may be expanded, intermediate its ends, to a larger second diameter. That is, the tubing is expanded to create a "bulge" in the tubing.

In one embodiment, the end portions of the tubing may form connections which are not extended, while the intermediate section, which may be sandscreen or the like, is expanded into contact with the surrounding bore wall.

In other aspects of the invention the tubing may initially feature sections of different diameters.

The invention also relates to apparatus for implementing the method, and to a bore lined in accordance with the method.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
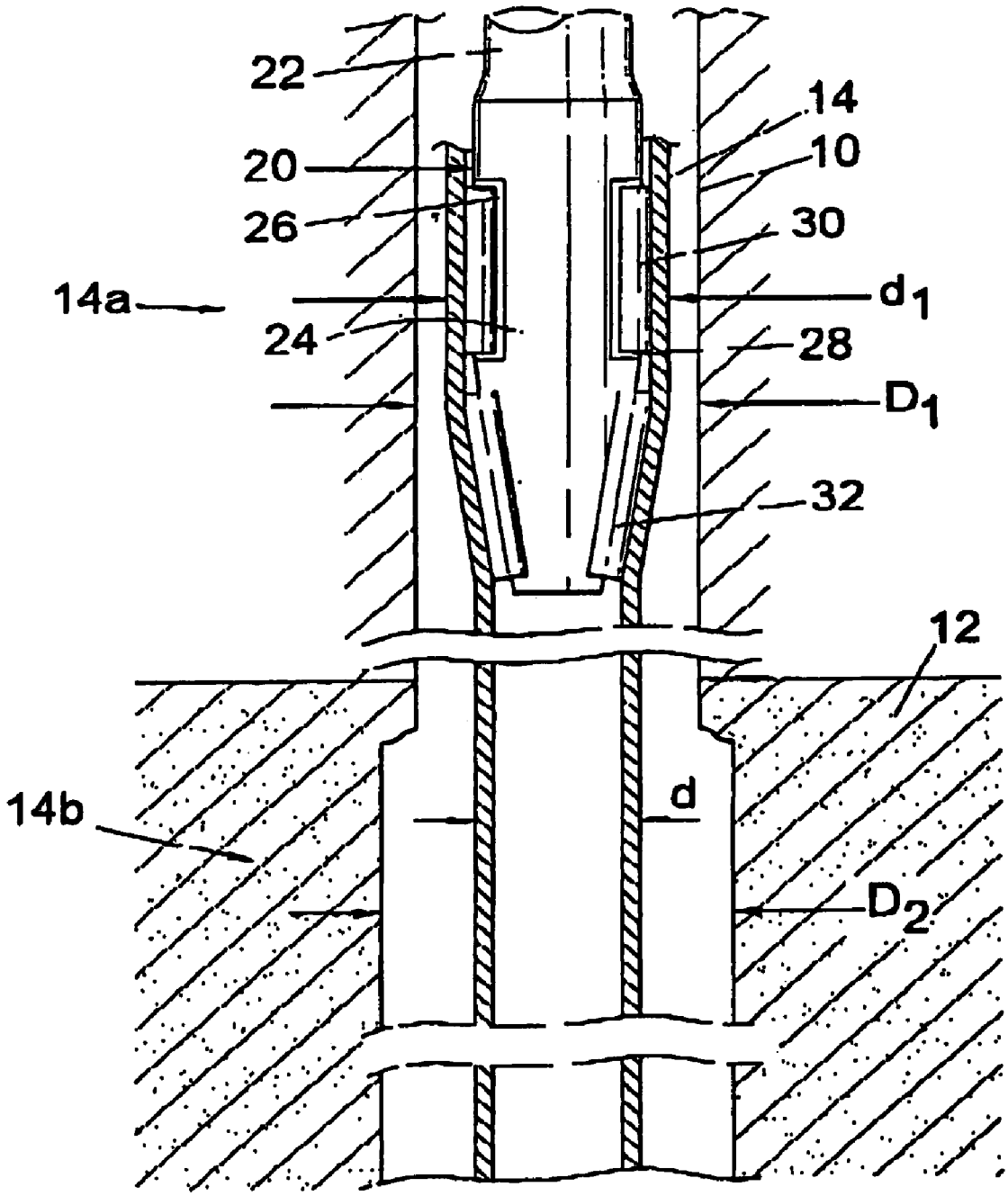
FIGS. 1 and 2 illustrate steps in a tubing expansion operation in accordance with a preferred embodiment of the present invention.
Figure 2:
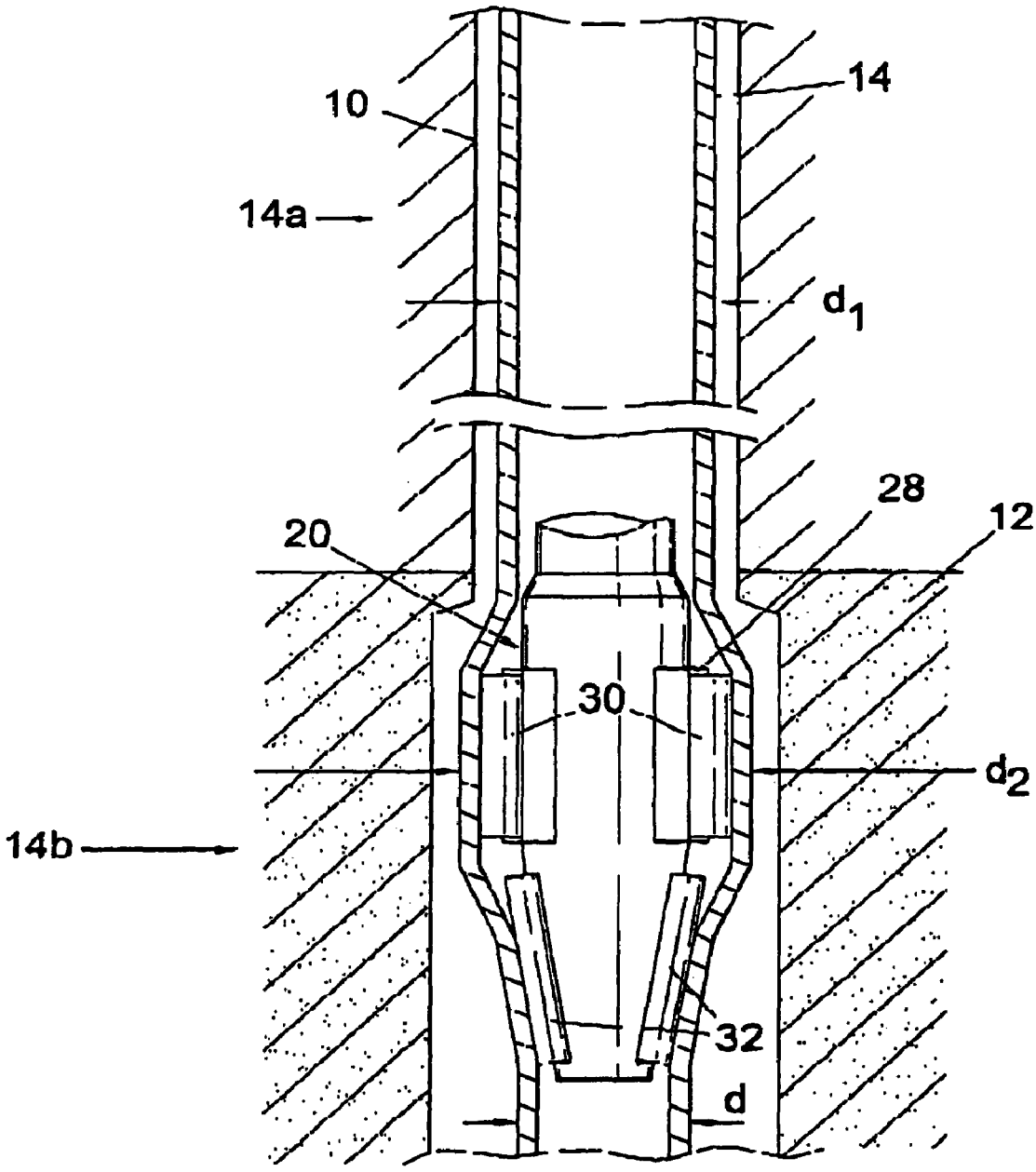
Figure 3:
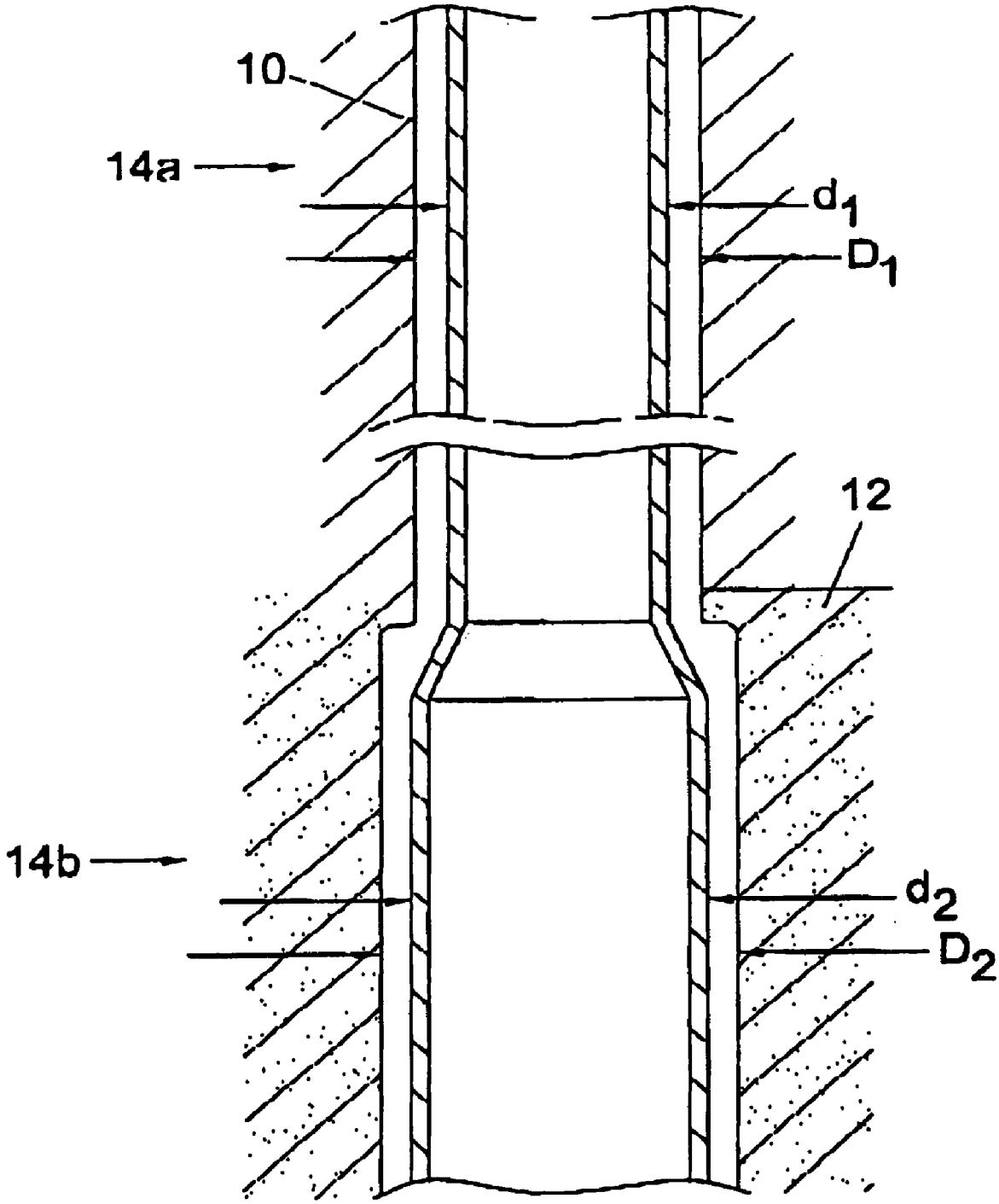
FIG. 3 illustrates expanded tubing following the expansion operation of FIGS. 1 and 2.

FIGS. 1, 2 and 3 of the drawings illustrates a part of a drilled bore 10, of diameter $D_1$, which has been drilled to access a subsurface hydrocarbon-bearing earth formation 12. Where the bore 10 intersects the formation 12, the bore has been underreamed to a larger diameter $D_2$. A length of expandable tubing 14, of initial or first diameter d, has been run into the bore 10. As will be described, a first section of the tubing 14*a* is expanded to a second diameter $d_1$ within the section of the bore with a diameter of $D_1$, and a second section of the tubing 14*b* is expanded to a third diameter $d_2$ within the section of the bore with a diameter of $D_2$, as illustrated in FIG. 3.

In the illustrated embodiment, the expansion is achieved using a rotary expansion tool 20 which is run into the bore with the tubing 14, and is mounted on the lower end of a drill pipe string 22. Of course in other embodiments other forms of expansion tool may be utilised, including expansion cones or mandrels. Also, fluid pressure may be utilised to at least assist in the expansion operation. The tool 20 comprises a hollow body 24 defining at least one and preferably three circumferentially spaced apertures 26 which each accommodate a respective piston 28 (only two shown), each piston providing mounting for a roller 30. The tool body 24 is in fluid communication with the hollow string 22, such that hydraulic pressure may be applied to the tool body interior and thus urge the pistons 28 radially outwardly and bring the rollers 30 into contact with the tubing 14, as will be described below. The leading end of the body 24 provides mounting for further rollers 32 which may be radially movable or fixed in a conical configuration, the maximum diameter described by the rollers 32 being similar to the diameter described by the retracted or unextended rollers 30.

To expand the first section of tubing 14*a*, as illustrated in FIG. 1, the tool 20 is rotated in the tubing and advanced axially through the tubing 14. The rotating rollers 32 subject the tubing wall to local compressive yield, leading to a decrease in wall thickness and corresponding increase in tubing diameter. The rollers 32 are configured such that the tubing tends to expand to the diameter $d_1$.

Once the first tubing section 14*a* has been expanded, pressurised fluid is supplied from surface to the expansion tool 20, which pressure urges the pistons 28 and the rollers 30 radially outwards as illustrated in FIG. 2. By rotating and advancing the now energised tool 20, the tubing 14 is first expanded to the diameter $d_1$ by the action of the fixed diameter rollers 32 and then subsequently expanded, by a similar mechanism, to the diameter $d_2$, by the energised rollers 30.

Once the tubing 14 has been expanded as desired, the rollers 30 may be retracted, and the tool 20 retrieved to surface through the expanded tubing.

Those of skill in the art will recognise that further operations will then be carried out, for example the expanded tubing may then be cemented and the second section 14*b* perforated.

Those of skill in the art will also recognise that this embodiment is merely exemplary of the present invention and that various modifications may be made thereto without departing from the scope of the invention. For example, the abovedescribed example features only two sections of tubing of two different diameters. In other examples, three or more sections of tubing of three or more different diameters might be provided. Alternatively, the diameter of the tubing may progressively increase over a section of tubing to form a tapering or flared bore. Furthermore, any appropriate form of expandable tubing and expansion tool or mechanism may be utilised, depending on the application.

Figure 4:
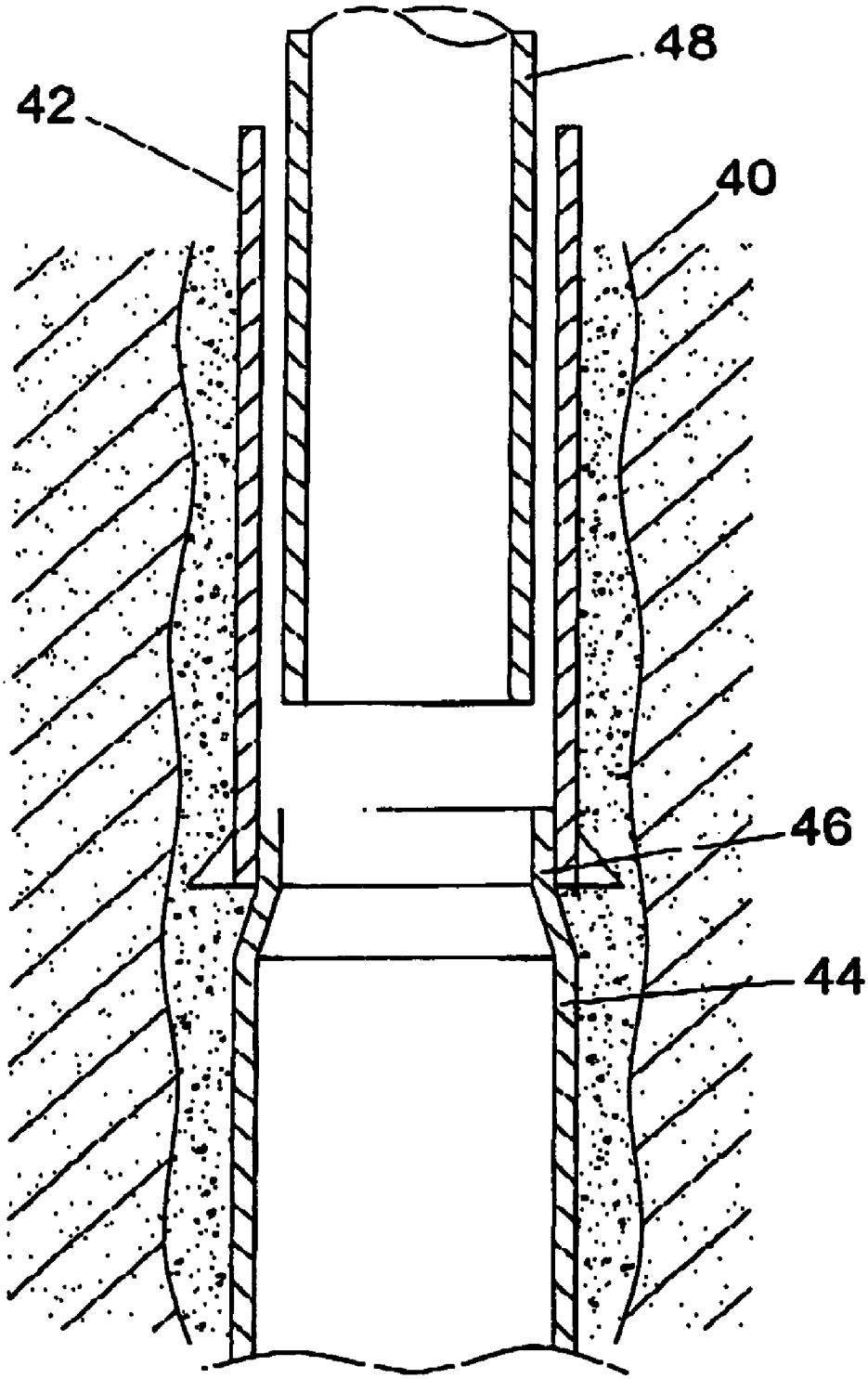
FIG. 4 is a schematic illustration of a step in the creation of a lined bore in accordance with a further embodiment of the invention.
Figure 5:
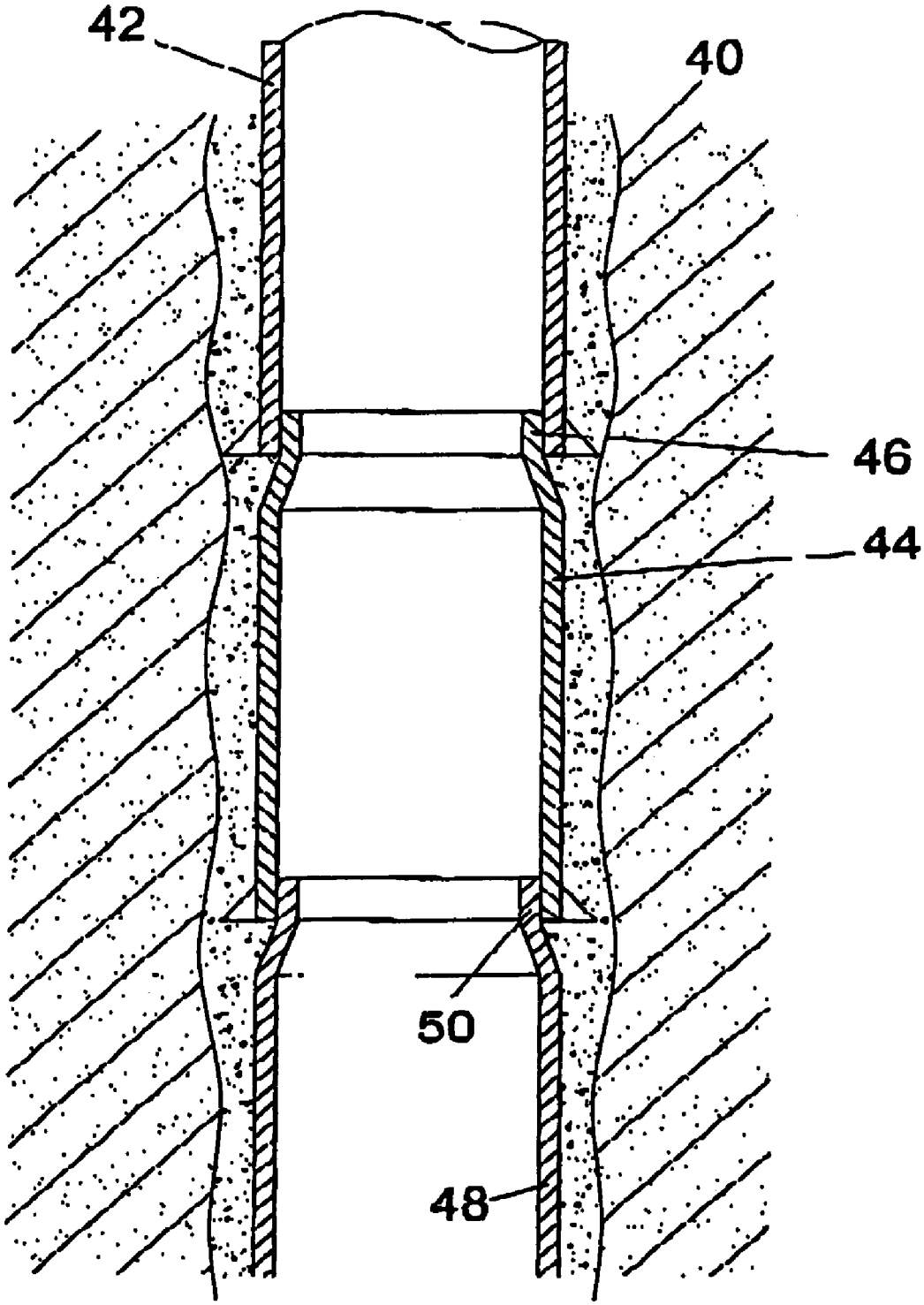
FIG. 5 is schematic illustration of a section of a lined bore made in accordance with said further embodiment of the invention.

Reference is now made to FIGS. 4 and 5 of the drawings, which illustrate the creation of a lined bore in accordance with a further embodiment of the invention.

FIG. 4 illustrates an upper end of a drilled bore 40 within which 9⅝" casing 42 has been located and cemented. In this example, the casing 42 has a inner diameter (i.d.) of 8.5". A length of 29 lb/ft 7⅝" (i.d. 6.8") casing 44 has then been run into the bore 40, such that the upper end of the casing 44 overlaps the lower end of the casing 42. The casing 44 has then been expanded, with the section of the casing 44 extending below the existing casing 42 being expanded to provide an i.d. similar to that of the casing 42, that is 8.5". However, at the overlap 46 between the casings 42, 44, the casing 44 can only be expanded to an outer diameter corresponding to the inner diameter of the existing casing 42; the casing 42 has been cemented and thus cannot be expanded. Thus, at the overlap 46, the inner diameter of the throughbore defined by the existing casing 42 and the expanded casing 44 is reduced by twice the thickness of the casing wall, that is twice ⅜", to 7.75".

The expanded casing 44 is cemented in the drilled bore, either prior to or following expansion. The expansion of the casing is achieved using a compliant expansion device, such as a fluid pressure actuated device as described above, or alternatively an expandable cone, which has the ability to expand the casing to the two different diameters, and be withdrawn through the smaller diameter overlap 46.

FIG. 4 also illustrates a further section of casing 48 being run into the bore through the section of the bore already lined by the existing casing 42 and the expanded casing 44. The casing 48 is identical to the unexpanded casing 44, and thus has an external diameter of 7⅝" (7.625"), and thus may pass through the overlap 46, which has an internal diameter of 7.75".

The casing 48 is run into the bore 40 until the upper end of the casing 48 overlaps the lower end of the now expanded, cemented casing 44. The casing 48 is then expanded and cemented, in a similar manner to the casing 44, and as illustrated in FIG. 5, then provides a further section of lined bore with a major section of 8.5" i.d. and a short section of 7.75" i.d., at the overlap 50 between the casing sections 44, 48.

A bore may thus be drilled and lined as described above, with no loss of diameter as the bore is extended. The loss of diameter at the overlaps 46, 50 is relatively minor, and offers advantages in, for example, providing ledges or profiles useful in locating tools and other devices in the bore, and more than compensates for the technical difficulties involved in expanding the casing sections 42, 44 at the overlaps 46, 50; proposals to this end include expanding the tubing before cementing, or before the cement has set, or providing arrangements to retain the lower end of the casing 42, 44 free of cement.

The upper end of the casing sections 44, 48 may be provided with sealing and locking arrangements suitable to provide a fluid tight and secure coupling at the overlaps 46, 50.

The invention claimed is:

1. A method of lining a drilled bore, the method comprising the steps:

(a) running a first tubing length of a first diameter into the bore;

(b) running a second tubing length into the bore and through the first tubing length after the first tubing length is in the bore, such that the second tubing length overlaps with a lower end of the first tubing length;

(c) expanding at least a first portion of the second tubing length where the tubing lengths overlap, to a second diameter smaller than the first diameter; and (d) expanding at least a second portion of a remainder of the second tubing length to a third diameter larger than the second diameter, wherein the second portion is longer than the first portion and extends beyond the first tubing length.

2. The method of claim 1, wherein step (c) brings the second tubing length into contact with the first tubing length at at least a portion of the overlap between the tubing lengths.

3. The method of claim 1, wherein following step (c) a fluid passage remains between the tubing lengths at the overlap.

4. The method of claim 1, further comprising expanding said first tubing length.

5. The method of claim 1, further comprising expanding said first tubing length to a variety of diameters.

6. The method of claim 1, further comprising expanding a portion of the second tubing length to a fourth diameter.

7. The method of claim 6, further comprising expanding a portion of the second tubing length to a fifth diameter.

8. The method of claim 1, further comprising expanding a portion of the second tubing length such that the diameter of the tubing length varies.

9. The method of claim 1, further comprising cementing the first tubing length in the bore.

10. The method of claim 1, further comprising cementing the first tubing length in the bore before expanding the second tubing length.

11. The method of claim 1, further comprising cementing the second tubing length in the bore.

12. The method of claim 1, further comprising cementing the second tubing length in the bore after step (c).

13. The method of claim 1, wherein the tubing lengths comprise solid-walled tubing.

14. The method of claim 1, wherein the tubing lengths comprise slotted tubing.

15. The method of claim 1, wherein the tubing lengths comprise expandable sand screen.

16. The method of claim 1, further comprising utilising an expansion tool in the form of an expansion cone and wherein at least part of the expansion is achieved by means of moving the expansion cone through the tubing lengths.

17. The method of claim 1, further comprising utilising an expansion tool in the form of a rotary expander and wherein at least part of the expansion is achieved by means of rotary expansion.

18. The method of claim 1,further comprising utilising a variable diameter expansion tool.

19. The method of claim 1, further comprising expanding at least one section of the tubing lengths to a non-uniform diameter using a compliant expansion tool.

20. The method of claim 1, further comprising utilising a retractable expander.

21. The method of claim 1, further comprising:

running a third tubing length into the bore such that the second and third tubing lengths overlap;

expanding a first segment of the third tubing length where the second and third tubing lengths overlap to a fourth diameter; and expanding a second segment of the third tubing length to a fifth diameter larger than the fourth diameter.

22. A method of lining a drilled bore, the method comprising the steps:

(a) running a first tubing length of a first diameter into the bore;

(b) expanding said first tubing length to a larger second diameter;

(c) running a second tubing length into the bore after step (a), such that an upper end of the second tubing length overlaps with a lower end of the first tubing length;

(d) expanding the upper end of the second tubing length to a third diameter larger than said first diameter but smaller than said second diameter; and (e) further expanding a majority of the second tubing length to said second diameter.

23. The method of claim 22, further comprising cementing the first tubing length.

24. The method of claim 23, further comprising allowing the cement to set before expanding the second tubing length.

25. The method of claim 22, further comprising cementing the second tubing length in the bore.

26. The method of claim 22, further comprising cementing the second tubing length in the bore after step (d).

27. The method of claim 22, wherein expanding the upper end of the second tubing length to said third diameter creates at least one of a hanging support and a seal between the upper end of the second tubing length and the lower end of the first tubing length.

28. The method of claim 22, wherein following step (d) a fluid passage remains between the tubing lengths at the overlap.

29. A method of lining a drilled bore, the method comprising the steps:

(a) running a first tubing length into the bore, wherein the first tubing length defines a first diameter;

(b) running a second tubing length into the bore after step (a), such that an upper end of the second tubing length overlaps with a lower end of the first tubing length;

(c) expanding the upper end of the second tubing length to a third diameter larger than the first diameter but smaller than a second diameter;

(d) further expanding a majority of the second tubing length to the second diameter; and (e) expanding at least a portion of the first tubing length to the second diameter larger than the first diameter.

30. The method of claim 29, wherein step (d) brings the second tubing length into contact with the first tubing length at at least a portion of the overlap between the tubing lengths.

31. The method of claim 29, wherein following step (d) a fluid passage remains between the tubing lengths at the overlap.

32. The method of claim 29, further comprising expanding said first tubing length to a variety of diameters.

33. The method of claims 29, further comprising expanding a portion of the second tubing length to a fourth diameter.

34. The method of claim 29, further comprising expanding a portion of the second tubing length to a variety of diameters.

35. The method of claim 29, further comprising cementing the first tubing length.

36. The method of claim 35, comprising allowing the cement to set before expanding the second tubing length.

37. The method of claim 29, further comprising cementing the second tubing length in the bore.

38. The method of claim 29, further comprising cementing the second tubing length in the bore after step (d).

39. The method of claim 29, comprising expanding the upper end of the second tubing length to a third diameter to create at least one of a hanging support and a seal between the upper end of the second tubing length and the lower end of the first tubing length.

40. The method of claim 29, further comprising:

running a third tubing length into the bore such that the second and third tubing lengths overlap;

expanding a first segment of the third tubing length where the second and third tubing lengths overlap to a fourth diameter; and expanding a second segment of the third tubing length to a fifth diameter larger than the fourth diameter.

41. A method of lining a drilled bore, comprising:

running a first tubing of a first diameter into the bore;

thereafter, running a second tubing into the bore and through the first tubing, such that the second tubing overlaps with a lower end of the first tubing;

expanding at least a first portion of the second tubing where the first and second tubing overlap, to a second diameter, wherein expanding the first portion places the second tubing in contact with the first tubing; and expanding at least a second portion of the second tubing adjacent the first portion to a third diameter larger than the second diameter, wherein the second portion is longer than the first portion and extends beyond the first tubing.

* * * * *